US009705181B2

(12) United States Patent
Yano et al.

(10) Patent No.: US 9,705,181 B2
(45) Date of Patent: Jul. 11, 2017

(54) ANTENNA CONNECTING STRUCTURE AND ELECTRONIC DEVICE INCLUDING SAME

(71) Applicant: KYOCERA CORPORATION, Kyoto (JP)

(72) Inventors: Kentaro Yano, Suita (JP); Takeshi Saimyoji, Osaka (JP); Katsushige Kohri, Osaka (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/926,987

(22) Filed: Oct. 29, 2015

(65) Prior Publication Data

US 2016/0126621 A1 May 5, 2016

(30) Foreign Application Priority Data

Oct. 29, 2014 (JP) ..... 2014-219993

(51) Int. Cl.

| | |
|---|---|
| ***H01Q 1/24*** | (2006.01) |
| ***H01Q 1/36*** | (2006.01) |
| ***H01Q 1/44*** | (2006.01) |
| ***H01Q 21/28*** | (2006.01) |

(52) U.S. Cl.

CPC ..... *H01Q 1/243* (2013.01); *H01Q 1/36* (2013.01); *H01Q 1/44* (2013.01); *H01Q 21/28* (2013.01)

(58) Field of Classification Search

CPC ..... H01Q 1/50; H01Q 1/24

See application file for complete search history.

(56) References Cited

U.S. PATENT DOCUMENTS

| | | | | |
|---|---|---|---|---|
| 2008/0164840 | A1 | 7/2008 | Kato et al. | |
| 2013/0088406 | A1* | 4/2013 | Hamada | H01Q 1/36 343/893 |
| 2014/0140018 | A1* | 5/2014 | Malek | H04M 1/0277 361/749 |

FOREIGN PATENT DOCUMENTS

| | | |
|---|---|---|
| JP | 2008-172872 A | 7/2008 |

* cited by examiner

*Primary Examiner* — Dameon E Levi
*Assistant Examiner* — Andrea Lindgren Baltzell
(74) *Attorney, Agent, or Firm* — Duane Morris LLP

(57) ABSTRACT

An antenna connecting structure includes a battery as a first component having a first main surface and a second main surface directed oppositely to the first main surface, a housing component including a flat portion located on the first main surface side, a spacer located on the first main surface, a sheet-like antenna unit main body located on a surface of the spacer opposite to the first main surface and abutting on the flat portion in surface contact, a circuit board disposed on the second main surface side and having a connector, an antenna connecting cable extending from the antenna unit main body and having flexibility, and an antenna connecting terminal disposed at an end of the antenna connecting cable and connected to the connector.

9 Claims, 8 Drawing Sheets

ANTENNA CONNECTING STRUCTURE AND ELECTRONIC DEVICE INCLUDING SAME

CROSS-REFERENCE TO RELATED APPLICATION

The present application claims priority under 35 U.S.C. §119 to Japanese Patent Application No. 2014-219993, filed on Oct. 29, 2014, entitled "Antenna Connecting Structure and Electronic Device Including the Same." The content of which is incorporated by reference herein in its entirety.

FIELD

The present disclosure relates to an antenna connecting structure and an electronic device including the same.

BACKGROUND

An antenna for power transmission or communication may be built in an electronic device. For power transmission, the PMA standard has been established by PMA (Power Matters Alliance), and the Qi standard has been established by WPC (Wireless Power Consortium), for example. On the other hand, for communication, there are various standards of NFC (Near Field Communication), for example. As an antenna for performing power transmission or communication in conformity with these standards, an antenna obtained by making a planar coil and fixing it to a surface of a sheet-like component (hereinafter referred to as a "sheet-like antenna") is usually used.

SUMMARY

The present disclosure desirably provides a novel antenna connecting structure and a novel electronic device.

The antenna connecting structure based on the present disclosure includes a first component having a first main surface and a second main surface directed oppositely to the first main surface, a housing component including a flat portion located on the side of the first main surface, a spacer located on the first main surface, a sheet-like antenna unit main body located on a surface of the spacer opposite to the first main surface and abutting on the flat portion in surface contact, a circuit board disposed on the side of the second main surface and having a connector, an antenna connecting cable extending from the antenna unit main body and having flexibility, and an antenna connecting terminal disposed at an end of the antenna connecting cable and connected to the connector.

The foregoing and other objects, features, aspects and advantages of the present disclosure will become more apparent from the following detailed description of the present disclosure when taken in conjunction with the accompanying drawings.

DETAILED DESCRIPTION

First Embodiment

Figure 1:
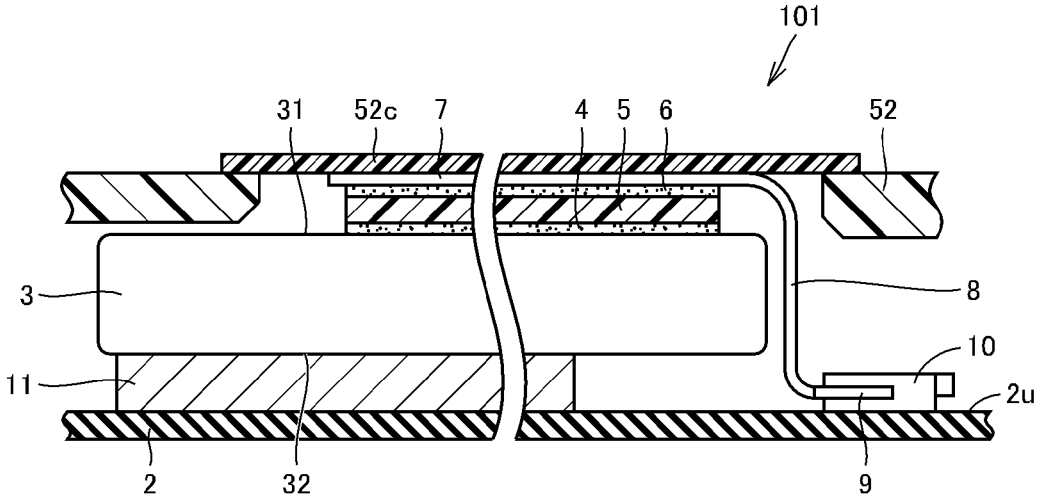
FIG. 1 is a cross sectional view of an antenna connecting structure according to a first embodiment based on the present disclosure.

Referring to FIGS. 1 to 8, an antenna connecting structure according to a first embodiment based on the present disclosure will be described.

An antenna connecting structure 101 according to the first embodiment includes a battery 3 as a first component having a first main surface 31 and a second main surface 32 directed oppositely to first main surface 31, a rear-side housing component 52 as a housing component including a flat portion 52*c* located on the first main surface 31 side, a spacer 5 bonded to first main surface 31, a sheet-like antenna unit main body 7 bonded to the surface of spacer 5 opposite to first main surface 31 and abutting on flat portion 52*c* in surface contact, a circuit board 2 disposed on the second main surface 32 side and having a connector 10, an antenna connecting cable 8 extending from antenna unit main body 7 and having flexibility, and an antenna connecting terminal 9 disposed at an end of antenna connecting cable 8 and connected to connector 10.

As shown in FIG. 1, flat portion 52*c* which is part of rear-side housing component 52 is obtained by affixing a thin plate of a different material from the other portion of rear-side housing component 52. Although flat portion 52*c* shall be obtained by affixing a thin plate of a different material from the other portion in the first embodiment, flat portion 52*c* may be achieved by affixing a thin plate of the same material as the other portion of rear-side housing component 52, or may be molded integrally with the other portion, without providing flat portion 52*c* as a separate member. Flat portion 52*c* only needs to have some flat plate-like portion as part of rear-side housing component 52 so as to be opposed to first main surface 31.

Antenna unit main body 7, antenna connecting cable 8 and antenna connecting terminal 9 shall be hereinafter collectively referred to as an "antenna unit 27."

Figure 2:
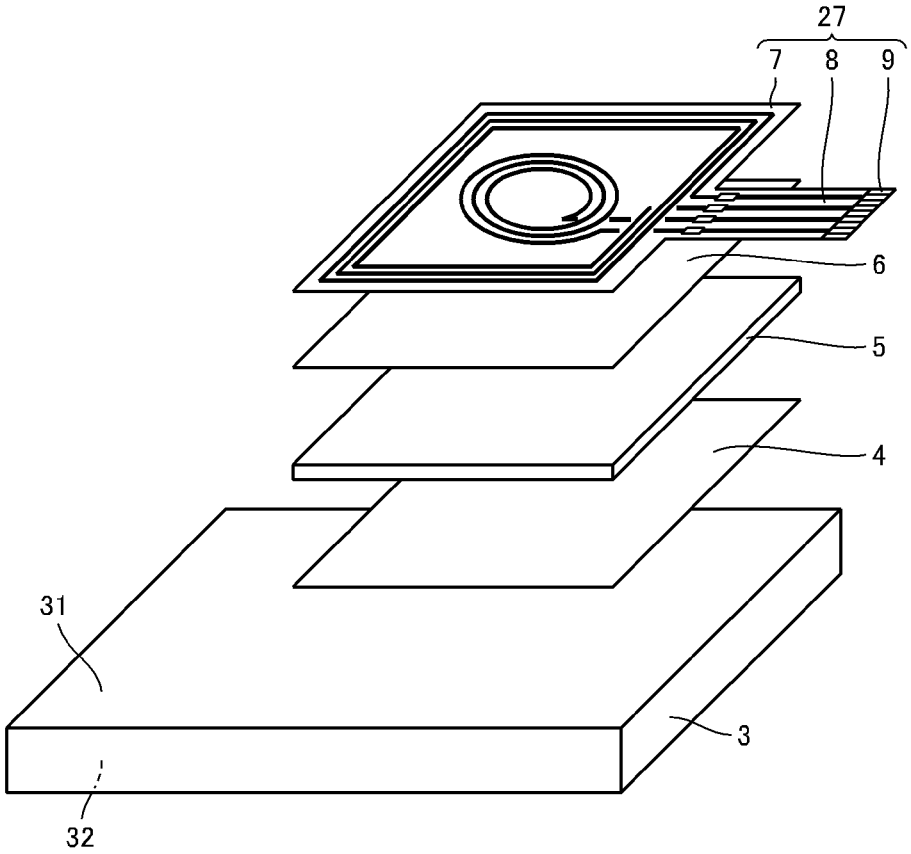
FIG. 2 is an exploded view of a battery, a spacer, an antenna unit, and the like included in the antenna connecting structure according to the first embodiment based on the present disclosure.
Figure 3:
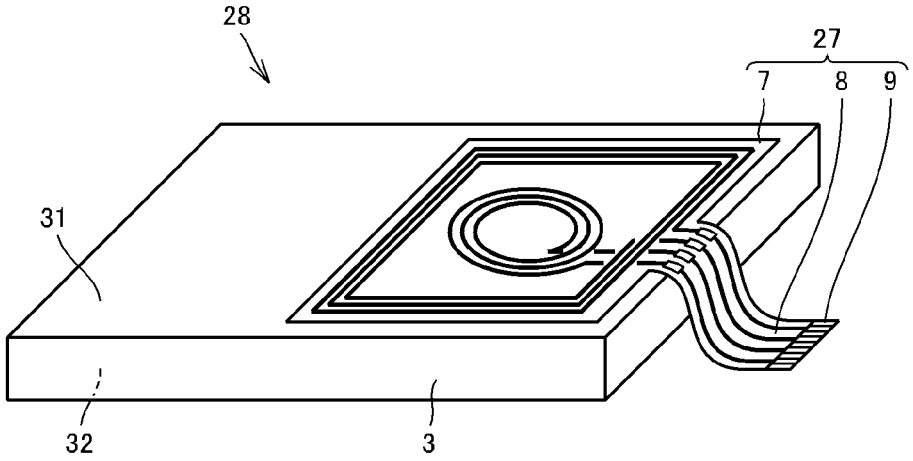
FIG. 3 is a perspective view of a battery unit included in the antenna connecting structure according to the first embodiment based on the present disclosure.

Battery 3, spacer 5 and antenna unit 27 are assembled as shown in FIG. 2. Spacer 5 is applied to first main surface 31 of battery 3 with an adhesive sheet 4 interposed there between. Spacer 5 is a sheet-like member. Antenna unit main body 7 is applied to spacer 5 with an adhesive sheet 6 interposed there between. Antenna connecting cable 8 extends from antenna unit main body 7 in one direction, and antenna connecting terminal 9 is provided at an end of antenna connecting cable 8. When applying adhesive sheet 4, spacer 5, adhesive sheet 6, and antenna unit main body 7 to first main surface 31 of battery 3, they are applied at such positions that antenna connecting cable 8 protrudes from first main surface 31 of battery 3 by a length sufficient for connection to be performed later. The result of applying them is shown in FIG. 3. At a stage in the course of assembling antenna connecting structure 101, a structure as shown in FIG. 3 is obtained as a single component. This shall be hereinafter referred to as a "battery unit 28."

Figure 4:
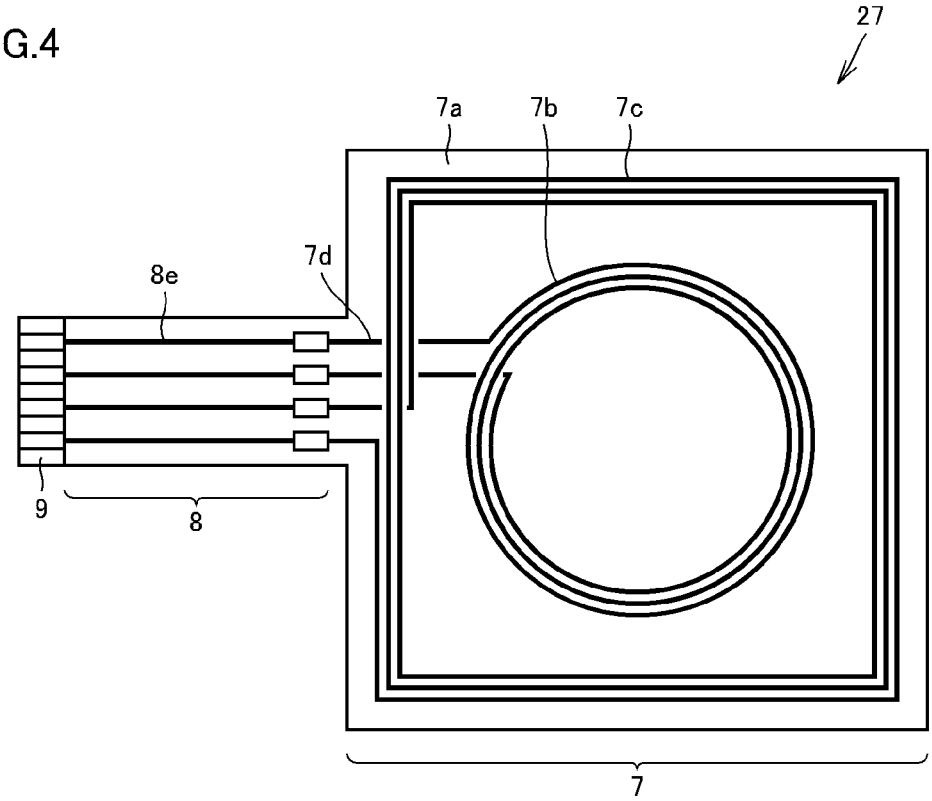
FIG. 4 is a plan view of the antenna unit included in the antenna connecting structure according to the first embodiment based on the present disclosure.

A plan view of antenna unit 27 taken out alone is shown in FIG. 4. Antenna unit main body 7 which is part of antenna unit 27 includes a sheet-like ferrite base material 7*a*, a first coil 7*b* and a second coil 7*c* fixed to a surface of ferrite base material 7*a*, and a leading wire 7*d*. First coil 7*b* and second coil 7*c* are electrically drawn out by leading wire 7*d*. A plurality of traces 8*e* are disposed in parallel in antenna connecting cable 8, and leading wires 7*d* are connected to traces 8*e*. Traces 8*e* are electrically connected to antenna connecting terminal 9.

First coil 7*b* is an antenna for carrying out power transmission based on, for example, the PMA standard or the Qi standard. First coil 7*b* is substantially circular, for example. Second coil 7*c* is an antenna for performing NFC, for example. Second coil 7*c* is substantially square, for example. The shape, number, positional relationship, intended use, and the like of the coils provided for antenna unit main body 7 in FIGS. 3 and 4 are merely shown as an example and are not limited to those shown here. Although in the example shown in FIGS. 3 and 4, two antennas in total, namely, first coil 7*b* and second coil 7*c*, are arranged in one antenna unit main body 7, this is not a limitation, but the number of the coils included in one antenna unit main body 7 as an antenna may be one, or may be more than two.

In antenna unit 27 illustrated in FIG. 4, antenna unit main body 7, antenna connecting cable 8 and antenna connecting terminal 9 are formed integrally into a sheet-like shape. Preparing them integrally in this manner leads to ease of handling in operations, such as assembly, replacement and disassembly, which is preferable.

The configuration, scale ratio, positional relationship, and the like of antenna unit main body 7, antenna connecting cable 8 and antenna connecting terminal 9 shown in the first embodiment are merely an example and are not limited to those shown here.

Figure 5:
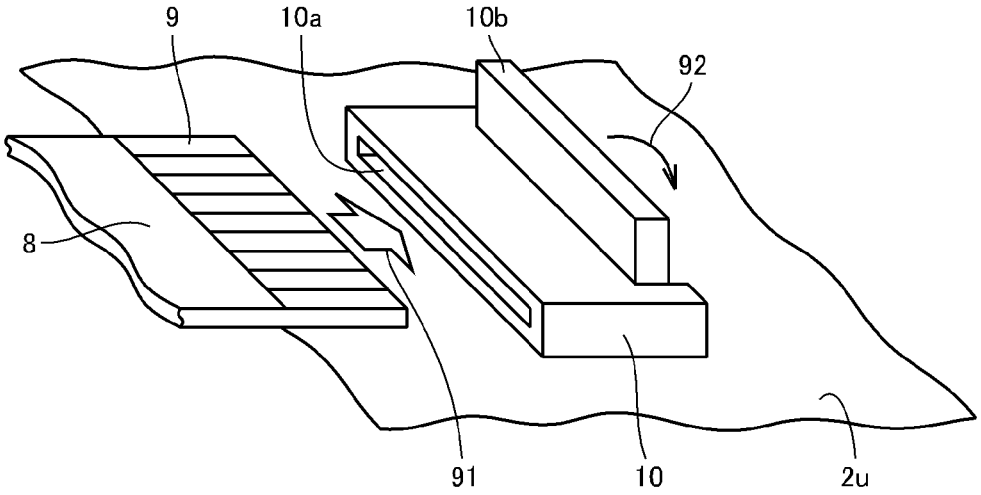
FIG. 5 is an explanatory drawing showing how to connect an antenna connecting terminal to a connector for assembling the antenna connecting structure according to the first embodiment based on the present disclosure.
Figure 6:
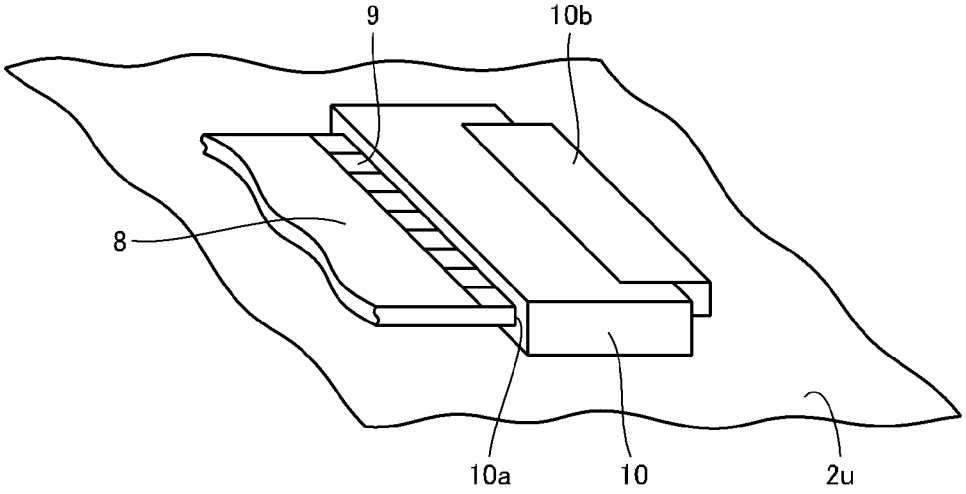
FIG. 6 is a partial enlarged perspective view of the antenna connecting structure according to the first embodiment based on the present disclosure, with the antenna connecting terminal connected to the connector.

How to connect antenna connecting terminal 9 to connector 10 will be described with reference to FIGS. 5 and 6. Connector 10 arranged on a surface 2*u* of circuit board 2 has a receiving portion 10*a* which opens to the lateral side. Antenna connecting terminal 9 provided at the leading end of antenna connecting cable 8 is inserted into receiving portion 10*a* of connector 10 as indicated by an arrow 91 in FIG. 5. Connector 10 includes a switch 10*b*. Switch 10*b* protrudes upward in the unconnected state as shown in FIG. 5, and is brought into the state shown in FIG. 6 when folded back as indicated by an arrow 92 after insertion of antenna connecting terminal 9 into receiving portion 10*a*. Antenna connecting terminal 9 is locked within receiving portion 10*a*. The configuration of connector 10 shown here is merely an example, and is not limited to that shown here.

Figure 7:
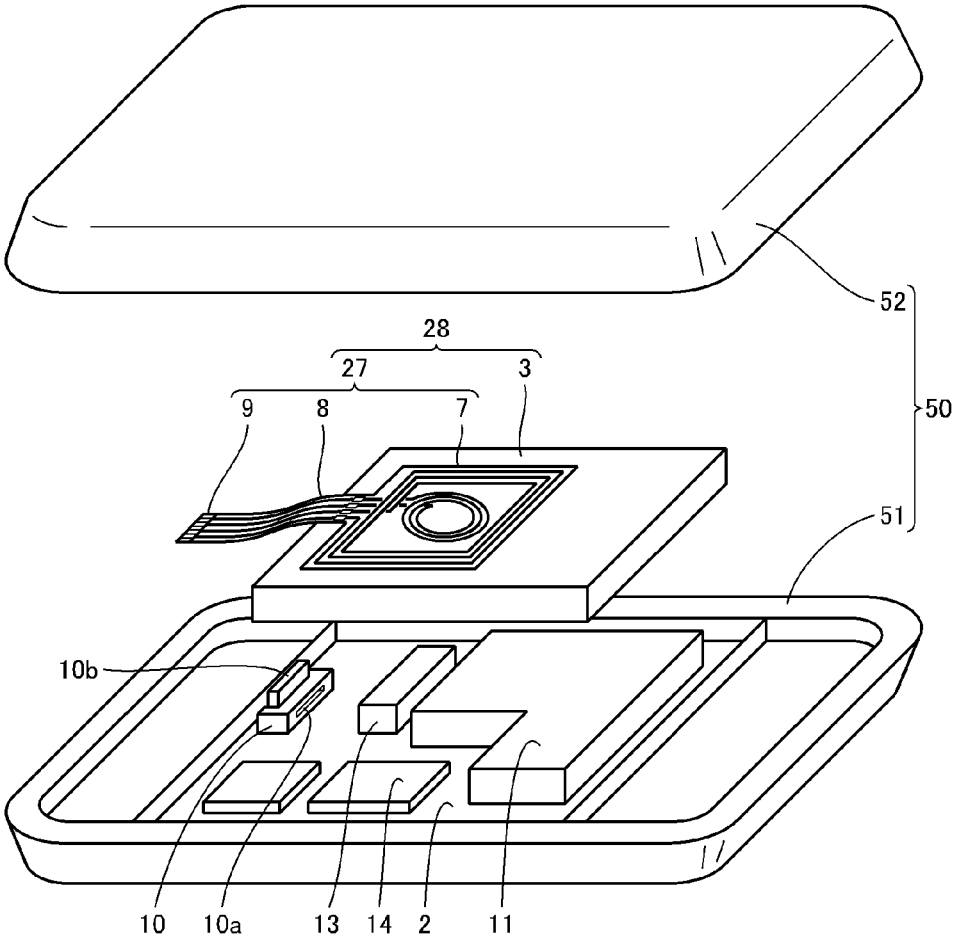
FIG. 7 is an exploded view of an electronic device according to a sixth embodiment based on the present disclosure.

An example of how to attach battery unit 28 shown in FIG. 3 to the inside of the electronic device is shown in FIG. 7. Front-side housing component 51 and rear-side housing component 52 are assembled to constitute a housing 50. A main display portion of this electronic device is provided on the surface of front-side housing component 51 facing downward in FIG. 7. A shield cover 11 serving as a second component is arranged on the side of front-side housing component 51 facing upward in FIG. 7. Shield cover 11 is a cover that covers small components while electromagnetically shielding them. Shield cover 11 is made of metal. In the example shown here, shield cover 11 is arranged on a surface of circuit board 2. Shield cover 11 has a height from the surface of circuit board 2 greater than those of other components 13 and 14. Connector 10 is arranged on the surface of circuit board 2. Components 13 and 14 shown here are merely illustration of components disposed around shield cover 11, and the number, size, and positional relationship thereof are not limited to those shown here. Components other than those shown here are also disposed within front-side housing component 51 as appropriate.

Figure 8:
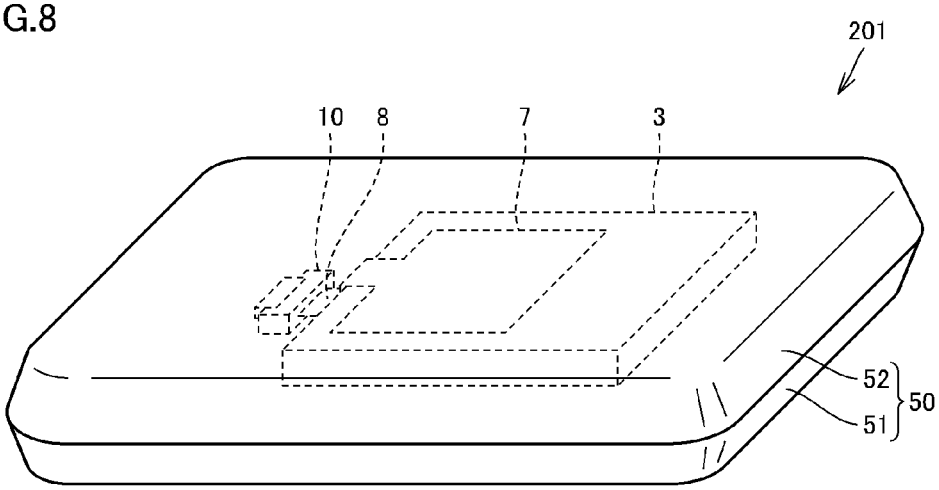
FIG. 8 is a perspective view of the electronic device according to the sixth embodiment based on the present disclosure.

As shown in FIG. 7, antenna connecting terminal 9 is inserted into receiving portion 10*a* of connector 10, and is locked by folding back switch 10*b*. In this state, battery 3 is placed on shield cover 11 with antenna unit main body 7 facing upward. Although not visible in FIG. 7, spacer 5 as shown in FIGS. 1 and 2 is interposed between antenna unit main body 7 and battery 3. In the example shown in FIG. 7, since shield cover 11 is higher than components 13 and 14, battery 3 is supported only by shield cover 11, and the weight of battery 3 does not act on components 13 and 14. After placing battery 3 on shield cover 11, rear-side housing component 52 is assembled with front-side housing component 51. An electronic device 201 is thus obtained as shown in FIG. 8.

Since the assembly operation is performed with antenna unit main body 7 bonded to battery 3 not to rear-side housing component 52 in the first embodiment, the connection of antenna connecting terminal 9 to connector 10 can be performed easily and reliably at a stage before attaching rear-side housing component 52 to front-side housing component 51. Since various types of connectors in accordance with publicly known techniques are usable as connector 10, connecting means, such as a contact terminal, of the type that applies a force in the direction perpendicular to the circuit board can be avoided. No load is thus imposed on the circuit board, and contact failure due to wear can be avoided.

Although the first component shall be battery 3 in the first embodiment, the first component may be a component other than battery 3. However, it is preferable that the first component be battery 3, as described in the first embodiment. Battery 3 actually occupies a relatively great volume in the housing of the electronic device. Provided that the first component is battery 3, antenna unit main body 7 can be pressed against the inner surface of rear-side housing component 52 utilizing the large size of battery 3, and the antenna included in antenna unit main body 7 can be located at a position close to the outermost surface.

Connector 10 is preferably a plug-in connector. By adopting this configuration, electrical connection can be made without directly putting pressure as with a contact terminal, which can avoid pressure from being put on circuit board 2. Antenna connecting terminal 9 may be inserted into the plug-in connector in any direction.

More preferably, the above-described plug-in connector is arranged on surface 2*u* of circuit board 2, and is connected by inserting antenna connecting terminal 9 therein in the direction parallel to surface 2*u* of circuit board 2. Connector 10 illustrated in the first embodiment satisfies this condition. By adopting this configuration, a force in the perpendicular direction can be avoided more reliably from being put on circuit board 2 in the operation of inserting antenna connecting terminal 9 into the plug-in connector.

When oriented such that first main surface 31 faces upward, the first component is preferably supported by the second component disposed on surface 2*u* of circuit board 2. In the first embodiment, this condition is satisfied because battery 3 is the first component and shield cover 11 is the second component. By adopting this configuration, the first component can be avoided from pressing other components arranged on circuit board 2, and antenna unit main body 7 applied to the first main surface of the first component with the spacer interposed there between can be reliably pressed against flat portion 52*c*. Preferably, the second component is a component having a certain degree of rigidity and characteristics that will be fine even with a load as heavy as the weight of the first component acting thereon. From this viewpoint, shield cover 11 is suitable for the second component.

Second Embodiment

Figure 9:
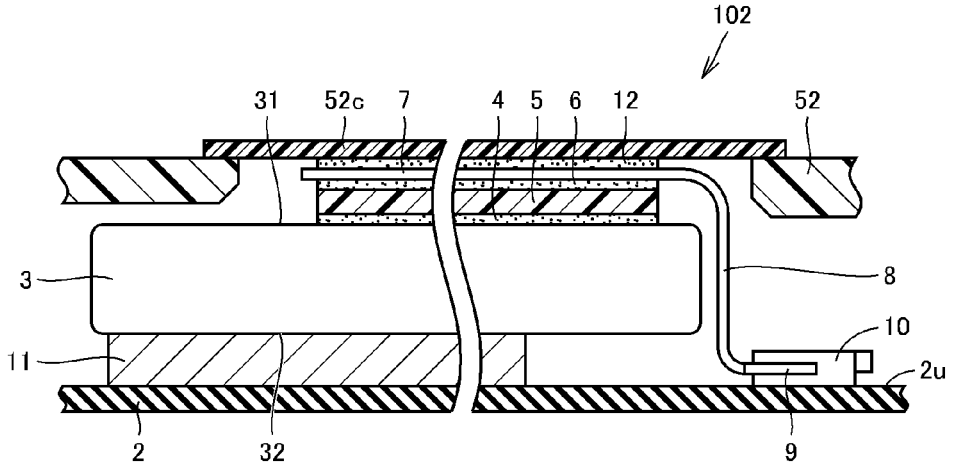
FIG. 9 is a cross sectional view of an antenna connecting structure according to a second embodiment based on the present disclosure.

Referring to FIG. 9, an antenna connecting structure according to a second embodiment based on the present disclosure will be described. An antenna connecting structure 102 according to the second embodiment has the same fundamental configuration as antenna connecting structure 101 described in the first embodiment, but differs in the following points.

In antenna connecting structure 102, antenna unit main body 7 has been bonded to flat portion 52*c*. As shown in FIG. 9, an adhesive sheet 12 is interposed between antenna unit main body 7 and flat portion 52*c*. Antenna unit main body 7 and flat portion 52*c* thereby not only abut on each other in surface contact, but have been bonded to each other.

If antenna unit main body 7 and flat portion 52*c* only abut on each other in surface contact without being bonded to each other, a sound or the like originating from the electronic device may cause vibration in flat portion 52*c*. This vibration may cause discomfort to a user. However, if antenna unit main body 7 has been bonded to flat portion 52*c* as described in the second embodiment, flat portion 52*c* can be prevented from vibrating.

Third Embodiment

Figure 10:
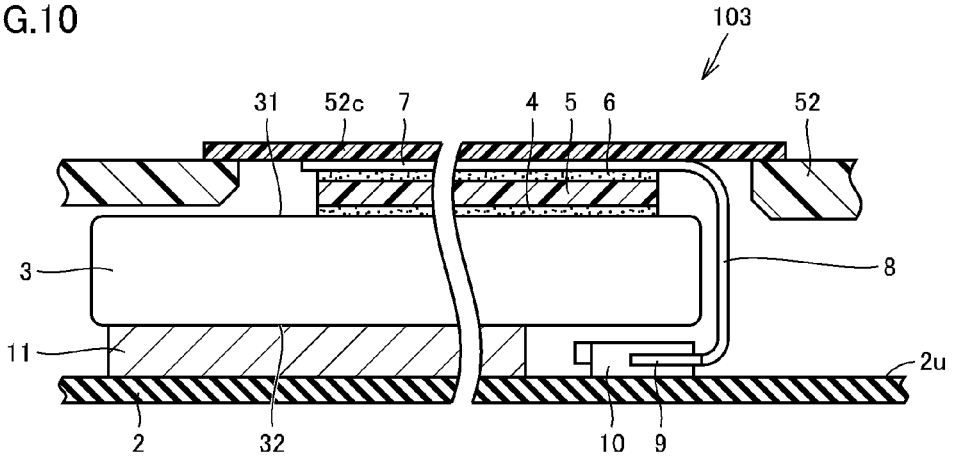
FIG. 10 is a cross sectional view of an antenna connecting structure according to a third embodiment based on the present disclosure.

Referring to FIG. 10, an antenna connecting structure according to a third embodiment based on the present disclosure will be described. An antenna connecting structure 103 according to the third embodiment has the same fundamental configuration as antenna connecting structure 101 described in the first embodiment, but differs in the following points.

In antenna connecting structure 103, connector 10 is disposed within the projection area of battery 3 serving as the first component, on surface 2*u* of circuit board 2. Connector 10 is disposed so as to be hidden under battery 3.

Since the assembly operation is performed with antenna unit main body 7 bonded to battery 3 not to rear-side housing component 52 in the third embodiment, the connection of antenna connecting terminal 9 to connector 10 can be performed before attaching rear-side housing component 52 to front-side housing component 51. The configuration in which connector 10 is located at the position as shown in FIG. 10 can thus also be applied. Since connector 10 may be disposed within the projection area of the first component, the area under the first component can be used effectively, which allows space saving. The configurations shown in FIGS. 1 and 10 are not limitation, but connector 10 can be placed freely at any place where antenna connecting cable 8 can reach.

The configuration in which connector 10 is disposed so as to be entirely included in the projection area of battery 3 is not limitation, but a configuration in which a portion of connector 10 is included in the projection area of battery 3 can also achieve a certain degree of space saving.

Fourth Embodiment

Figure 11:
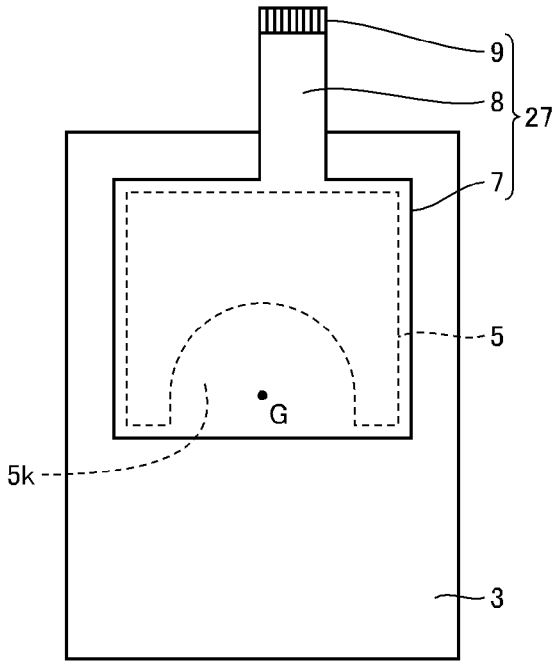
FIG. 11 is a plan view of a battery unit provided for an antenna connecting structure according to a fourth embodiment based on the present disclosure.

Referring to FIG. 11, an antenna connecting structure according to a fourth embodiment based on the present disclosure will be described. The antenna connecting structure according to the fourth embodiment has the same fundamental configuration as antenna connecting structure 101 described in the first embodiment, but differs in the following points.

The first component is battery 3. When viewed in a plan view, spacer 5 has a notch 5*k* so as to avoid a centroid G when battery 3 serving as the first component is viewed in a plan view. In the example shown in FIG. 11, notch 5*k* has a U-shape, but it may be semicircular or may have another shape. In FIG. 11, coils and the like included in antenna unit 27 are not illustrated. In some of the drawings to be described below, illustration is omitted similarly.

A phenomenon that a battery expands because of aged deterioration or the like is known. If spacer 5 is provided with notch 5*k* so as to avoid centroid G of battery 3 as described in the fourth embodiment, slight expansion of battery 3 can be received by notch 5*k*. The degree of deformation of flat portion 52*c* of rear-side housing component 52 caused by compression under the influence of expansion of battery 3 can thus be reduced.

Figure 12:
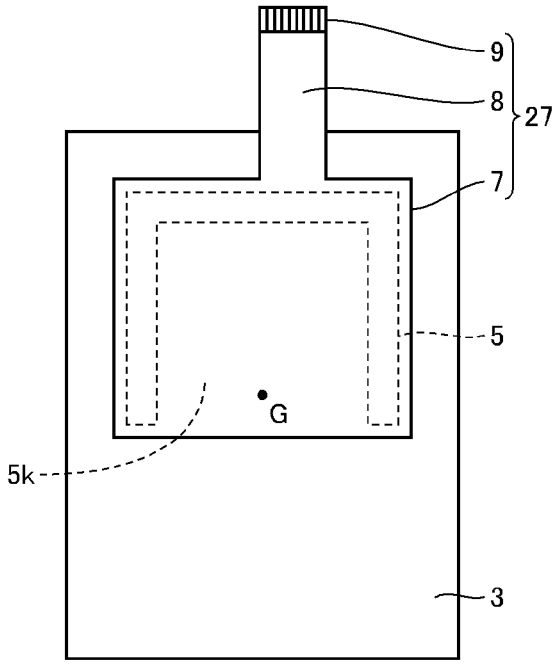
FIG. 12 is a plan view of a battery unit provided for a variation of the antenna connecting structure according to the fourth embodiment based on the present disclosure.

An example shown in FIG. 12 is also applicable besides the example shown in FIG. 11. In the example shown in FIG. 12, notch 5*k* is larger, and spacer 5 is provided in such a shape along three of the four sides of antenna unit main body 7 except for the side closest to centroid G. Spacer 5 in this case can also be recognized as being provided in an inverted U-shape. Spacer 5 may be composed of a plurality of members, rather than having a continuous inverted U-shape. As spacer 5, three linear members may be disposed along three sides of antenna unit main body 7, respectively.

Fifth Embodiment

Figure 13:
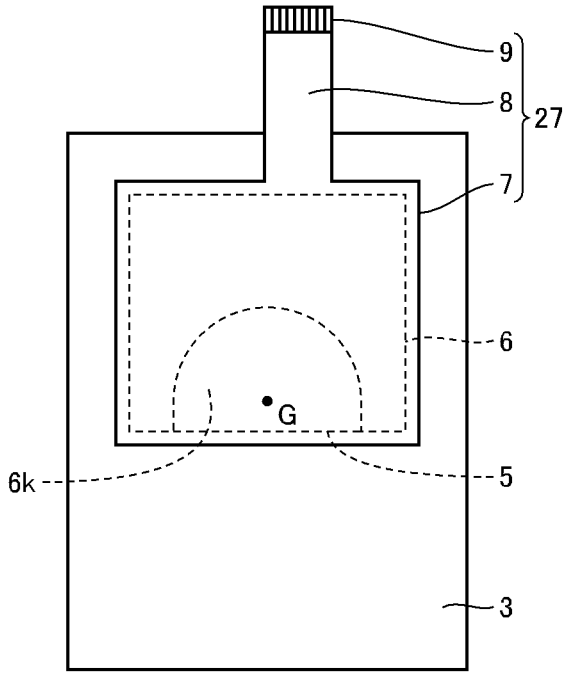
FIG. 13 is a plan view of a battery unit provided for an antenna connecting structure according to a fifth embodiment based on the present disclosure.
Figure 14:
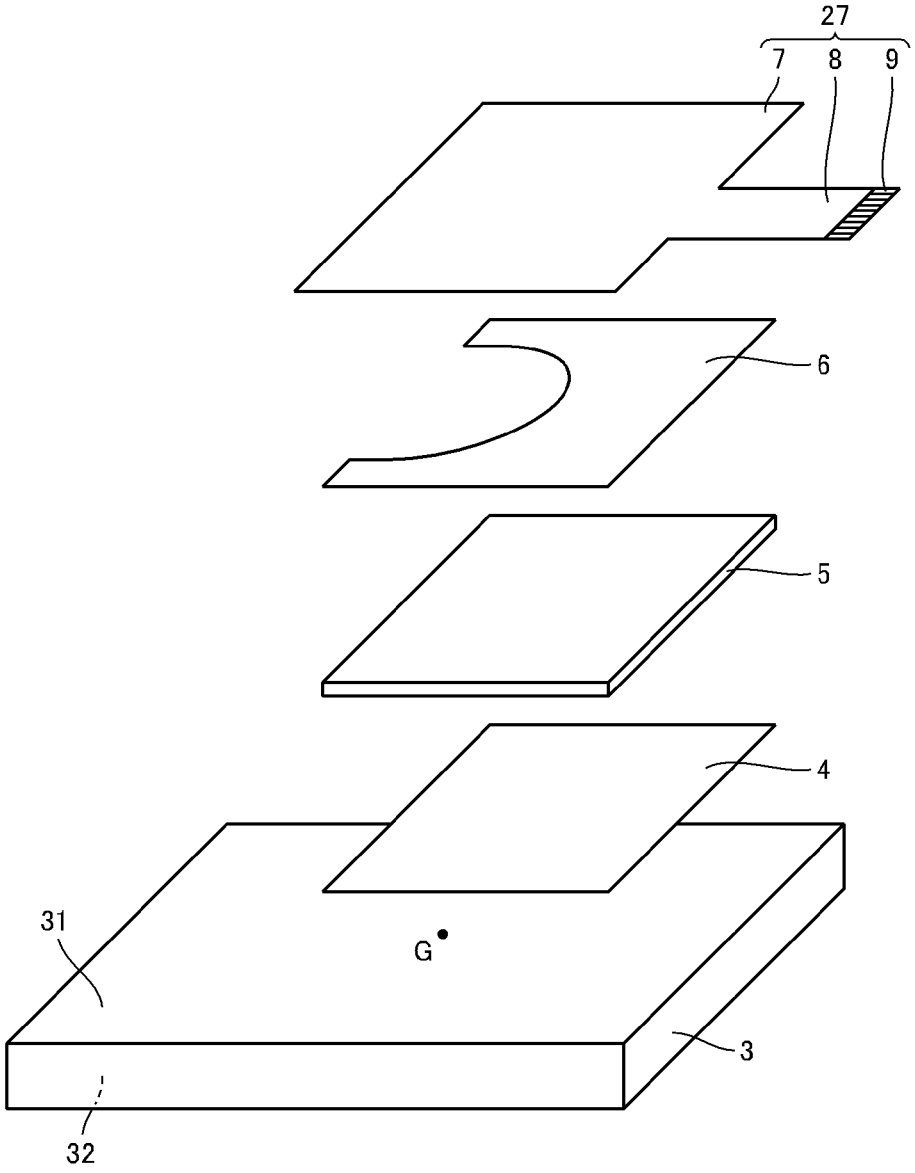
FIG. 14 is an exploded view of the battery unit provided for the antenna connecting structure according to the fifth embodiment based on the present disclosure.

Referring to FIGS. 13 and 14, an antenna connecting structure according to a fifth embodiment based on the present disclosure will be described. The antenna connecting structure according to the fifth embodiment has the same fundamental configuration as antenna connecting structure 101 described in the first embodiment, but differs in the following points.

The first component is battery 3. Bonding between spacer 5 and antenna unit main body 7 or bonding between first main surface 31 and spacer 5 has been done only in an area that avoids centroid G when battery 3 serving as the first component is viewed in a plan view, in the whole area of spacer 5. FIG. 13 shows a plan view of battery 3 with antenna unit main body 7 applied thereto, and FIG. 14 shows an exploded view. In the example shown in FIGS. 13 and 14, bonding between spacer 5 and antenna unit main body 7 has been done only in the area that avoids centroid G. Adhesive sheet 6 used for this bonding has a shape including a notch 6*k*. Although spacer 5 is rectangular, adhesive sheet 6 is refracted greatly by the presence of notch 6*k* to present a shape that avoids centroid G.

Since bonding on the upper or lower side of spacer 5 has been done only in the area that avoids centroid G in the fifth embodiment, slight expansion of battery 3 can be absorbed, and the degree of deformation of flat portion 52*c* of rear-side housing component 52 under the influence of expansion can be reduced.

Both the bonding between spacer 5 and antenna unit main body 7 and the bonding between first main surface 31 and spacer 5 may be done only in the area that avoids centroid G when battery 3 serving as the first component is viewed in a plan view, in the whole area of spacer 5.

Although the bonding between spacer 5 and antenna unit main body 7 and the bonding between first main surface 31 and spacer 5 have been described as being achieved through use of adhesive sheets in the above respective embodiments, it is not indispensable to adopt adhesive sheets in bonding, but an adhesive, for example, may be applied to desired areas of those members. The same also holds for adhesive sheet 12 according to the second embodiment, and an adhesive may be applied instead of using an adhesive sheet.

An "adhesive sheet" may be obtained by applying an adhesive to both surfaces of a sheet-like base material made of resin or the like, or may be obtained by forming an adhesive itself into a sheet, which exhibits adhesion in use by the function of temperature, pressure or the like.

For example, in the configuration of the fifth embodiment, spacer 5 with an adhesive previously adhered to both surfaces thereof may be used instead of the combination of adhesive sheet 4, spacer 5 and adhesive sheet 6. If an adhesive sheet including a base material having a desired thickness sufficient to serve as a spacer is used, this corresponds to spacer 5 with an adhesive previously adhered to both surfaces thereof.

Sixth Embodiment

Referring to FIG. 8, an electronic device according to a sixth embodiment based on the present disclosure will be described. Electronic device 201 according to the sixth embodiment includes the antenna connecting structure described in any of the above embodiments. FIG. 7 shows an exploded view of electronic device 201 shown in FIG. 8. Electronic device 201 includes the antenna connecting structure described in the first embodiment as an example.

Since the electronic device according to the sixth embodiment includes the antenna connecting structure described in any of the above embodiments, it imposes no load to the circuit board, and can avoid contact failure due to wear.

Although the present disclosure has been described and illustrated in detail, it is clearly understood that the same is by way of illustration and example only and is not to be taken by way of limitation, the scope of the present disclosure being interpreted by the terms of the appended claims.

The invention claimed is:

1. An antenna connecting structure, comprising:

a first component having a first main surface and a second main surface directed oppositely to the first main surface;

a housing component including a flat portion located on the side of the first main surface;

a spacer located on the first main surface;

a sheet-like antenna unit main body located on a surface of the spacer opposite to the first main surface and abutting on the flat portion in surface contact;

a circuit board disposed on the side of the second main surface and having a connector;

an antenna connecting cable extending from the antenna unit main body and having flexibility; and an antenna connecting terminal disposed at an end of the antenna connecting cable and connected to the connector.

2. The antenna connecting structure according to claim 1, wherein the antenna unit main body is located on the flat portion.

3. The antenna connecting structure according to claim 1, wherein the first component comprises a battery.

4. The antenna connecting structure according to claim 3, wherein the spacer has a notch so as to avoid a centroid when the first component is viewed in a plan view.

5. The antenna connecting structure according to claim 3, wherein bonding between the spacer and the antenna unit main body or bonding between the first main surface and the spacer is done only in an area that avoids a centroid when the first component is viewed in a plan view, in the whole area of the spacer.

6. The antenna connecting structure according to claim 1, wherein the connector comprises a plug-in connector.

7. The antenna connecting structure according to claim 6, wherein the plug-in connector is arranged on a surface of the circuit board and connects the antenna connecting terminal by inserting the antenna connecting terminal in a direction parallel to the surface of the circuit board.

8. The antenna connecting structure according to claim 1, wherein when oriented such that the first main surface faces upward, the first component is supported by a second component disposed on the surface of the circuit board.

9. An electronic device comprising the antenna connecting structure as defined in claim 1.

* * * * *